US005735250A

United States Patent [19]

Rembold et al.

[11] Patent Number: 5,735,250

[45] Date of Patent: Apr. 7, 1998

[54] FUEL PUMP FOR TWO-STROKE INTERNAL COMBUSTION ENGINE

[75] Inventors: Helmut Rembold, Stuttgart; Gottlob Haag, Markgroeningen; Heinz Stutzenberger, Vaihingen, all of Germany

[73] Assignee: Robert Bosch, GmbH, Stuttgart, Germany

[21] Appl. No.: 687,897

[22] Filed: Jul. 29, 1996

[30] Foreign Application Priority Data

Jul. 28, 1995 [DE] Germany ..... 195 27 629.9

[51] Int. Cl.[6] ..... F02M 37/04

[52] U.S. Cl. ..... 123/504; 123/73 C; 417/395

[58] Field of Search ..... 123/504, 497, 123/499, 73 AD, 73 C; 417/395

[56] References Cited

U.S. PATENT DOCUMENTS

| | | | |
|---|---|---|---|
| 2,598,528 | 5/1952 | O'French | 123/499 |
| 4,327,695 | 5/1982 | Schechter | 123/504 |
| 4,338,904 | 7/1982 | Brinkman | 123/504 |
| 4,383,504 | 5/1983 | Walsworth | 123/73 AD |
| 4,551,076 | 11/1985 | DuBois | 123/73 C |
| 4,573,932 | 3/1986 | DuBois | 123/73 AD |
| 5,197,417 | 3/1993 | Tuckerman | 123/504 |
| 5,197,418 | 3/1993 | Wissman | 123/504 |
| 5,279,504 | 1/1994 | Williams | 417/395 |
| 5,364,234 | 11/1994 | Eickman | 417/395 |
| 5,365,893 | 11/1994 | Wissman | 123/73 C |

FOREIGN PATENT DOCUMENTS 4725593 of 0000 Germany .

*Primary Examiner*—Carl S. Miller

*Attorney, Agent, or Firm*—Edwin E. Greigg; Ronald E. Greigg

[57] ABSTRACT

A fuel pump for a two-stroke internal combustion engines, having a pump chamber with an inlet valve for connecting to a fuel delivery pump. An outlet valve for connecting to an injection nozzle of the engine, and an axially driven pump piston which defines the pump chamber. For the purposes of a simple structural embodiment for reasonably priced manufacture and flexible fuel metering, a stop is provided, which defines the intake stroke of the pump piston and whose relative position to the bottom dead center of the pump piston can be controlled as a function of operating parameters of the engine.

19 Claims, 2 Drawing Sheets

FUEL PUMP FOR TWO-STROKE INTERNAL COMBUSTION ENGINE

BACKGROUND OF THE INVENTION

The invention is based upon a fuel pump for a two-stroke internal combustion engine.

In a fuel pump of this kind (German patent application DE 41 25 593 A1) for a two-stroke engine in portable, manually operated tools, such as chain saws and the like, which has a pump piston which, for the feed stroke, is pneumatically driven by the pressure in the crank case of the two-stroke engine counter to the restoring force of a pump spring, the pump spring is embodied as a leaf spring packet of two curved leaf springs which are supported on both ends in supports in the pump housing and are centrally supported on the pump piston in the region of their maximal curvature. At least one support is secured in the pump housing so that it can move lateral to the stroke direction of the pump piston and can be moved via a manually adjustable set screw, by means of which the restoring force of the leaf spring packet can be changed. The individual leaf springs of the leaf spring packet are set so that only the one leaf spring is effective in a first stroke region of the pump piston and that the second leaf spring additionally becomes effective in a second stroke region. Consequently, with increasing pump piston stroke, the required actuation forces for the pump piston do not increase in linear fashion, but in accordance with a bent characteristic curve, by means of which the pump piston stroke is adapted to the characteristic curve of the throttle valve position in the air intake conduit. In this way, a richer mixture is set in the lower load region of the two-stroke engine, and a leaner mixture is set in the upper or full load region.

This kind of adaptation of the injected fuel quantity to the quantity of combustion air supplied to the combustion chamber of the combustion cylinder via the crank case is structurally very expensive and requires a relatively difficult adjustment. The characteristic curve, once set, does not change and can only be modified within limits via the set screw, which in turn requires a somewhat lengthy adjustment process. Furthermore, the injection pressure of the fuel into the combustion chamber changes with the changing load of the two-stroke engine.

OBJECT AND SUMMARY OF THE INVENTION

The fuel pump according to the invention has the advantage over the prior art of being structurally very simple and therefore very reasonably priced, which is the prime requirement, particularly for employment in portable, manually operated tools. The fuel metering is flexible and automatically adapts to the changing operating parameters of the two-stroke engine. The fuel metering is thus essentially more precise and the apportioned fuel quantity is injected into the combustion chamber of the combustion cylinder with ever constant injection pressure so that an equally favorable distribution of fuel is assured in all operating conditions of the engine.

According to an advantageous embodiment of the invention, the reciprocating piston stop is constituted by the outer circumference of an eccentric cam, which is disposed on the end face of the pump piston remote from the pump chamber, so that it can rotate in the pump housing around a rotational axis which is aligned lateral to the stroke direction of the pump piston. The eccentric cam is non-rotatably seated on a rotary shaft supported in the pump housing, which shaft is non-rotatably engaged by an adjusting lever coupled to a controlling unit.

According to an alternative embodiment of the invention, the stop is constituted by the end face of an adjusting piston, which is secured on the end face of the pump piston remote from the pump chamber so that it can move in the pump housing coaxial to the stroke direction of the pump piston. The adjusting piston is preferably screwed with an external thread into an internal thread embodied in the pump housing, and a laterally protruding adjusting lever, which is coupled to a controlling unit, is disposed on the free end of the adjusting piston, which projects from the pump housing.

According to a preferred embodiment of the invention, the throttle valve in the air intake conduit of the two-stroke engine is used as the controlling unit so that the pump piston intake stroke, and therefore the fuel quantity apportioned by the pump piston for injection, depends directly upon the throttle valve position and therefore is always adjusted as a function of the combustion air supplied to the combustion chamber of the combustion cylinder.

In an alternative embodiment, the controlling unit can also be embodied as an electrical final control element with a characteristic diagram control.

The invention will be better understood and further objects and advantages thereof will become more apparent from the ensuing detailed description of preferred embodiments taken in conjunction with the drawings.

DESCRIPTION OF THE PREFERRED EMBODIMENTS

Figure 1:
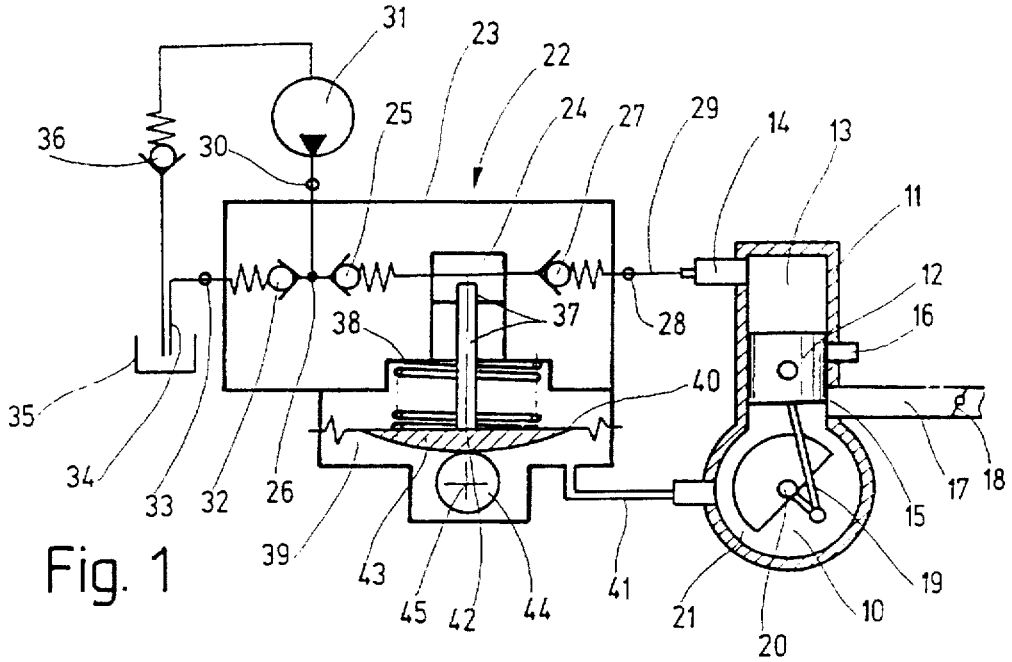
FIG. 1 shows a schematic representation of a two-stroke engine with a longitudinal section through a fuel pump.

In a known manner, the two-stroke engine shown in a schematic longitudinal section in FIG. 1 has a crank case 10 with at least one combustion cylinder 11 disposed in it and a combustion piston 12 axially guided in the combustion cylinder 11, which piston defines a combustion chamber 13 on its end face. For the purpose of injecting fuel into the combustion chamber 13, an injection device, here in the form of an injection nozzle 14, is integrated into the combustion cylinder 11 in the region of the combustion chamber 13. An air supply opening 15 and an exhaust outlet opening 16 are provided in the combustion cylinder 11, which are alternatingly opened and closed by the combustion piston 12 during its axial stroke motion. An air intake conduit 17 with a throttle valve 18 integrated into it is connected to the air supply opening 15, which throttle valve controls the combustion air supplied to the combustion chamber 13. Via a connecting rod 19, the stroke motion of the combustion piston 12 is converted into the rotation movement of a crankshaft 20 disposed in the crank case 10. The inner chamber 21 of the crank case 10 communicates with the combustion chamber 13 via an overflow conduit, not shown here, so that the combustion air, which flows into the inner chamber 21 of the crank case 10 via the air supply opening 15 during the upward movement of the combustion piston 12, flows into the combustion chamber 13 via the overflow conduit during the downward movement of the combustion piston 12.

A fuel pump 22 is connected to the injection nozzle 14. This has a pump chamber 24, which is embodied in a pump housing 23, which chamber communicates via an inlet valve 25 with a fuel supply 26 and communicates via an outlet valve 27 with a connecting fitting 28 for an injection line 29, which leads to the injection nozzle 14. Both the inlet valve 25 and the outlet valve 27 are embodied as check valves. On the one hand, the fuel supply 26 communicates with a second connecting fitting 30 for a prefeed pump 31 and on the other hand, it communicates with a connecting fitting 33 for a return line 34 via a pressure maintenance valve 32. The prefeed pump 31 delivers fuel from a fuel tank 35 via another check valve 36 to the connecting fitting 30 of the fuel pump 22, wherein the fuel is delivered from there via the pressure maintenance valve 32 in the circuit, back to the fuel tank 35 again.

The pump chamber 24 is defined by the end face of a pump piston 37, which is guided so that it can move axially in the pump housing 23 and is pneumatically driven to execute a pump motion with a feed and intake stroke. The feed stroke is carried out counter to the force of a pump spring 38, which is embodied as a helical compression spring and restores the pump piston 37 back to its bottom dead center during the intake stroke. To realize the pneumatic drive, a work chamber 39 is embodied in the pump housing 23, which chamber is defined on one end by a membrane 40 and is connected via an air tube 41 to the inner chamber 21 of the crank case 10. The pump piston 37 is centrally fastened to the membrane 40.

With a downward movement of the combustion piston 12 in the combustion cylinder 11, the pressure in the inner chamber 21 of the crank case 10 increases (overpressure) and then falls to a negative pressure with the upward movement of the combustion piston 12. These pressure fluctuations also occur in the work chamber 39 of the fuel pump 22 via the air tube 41, by means of which the pump piston 37 is driven to carry out the stroke motion.

Figure 2:
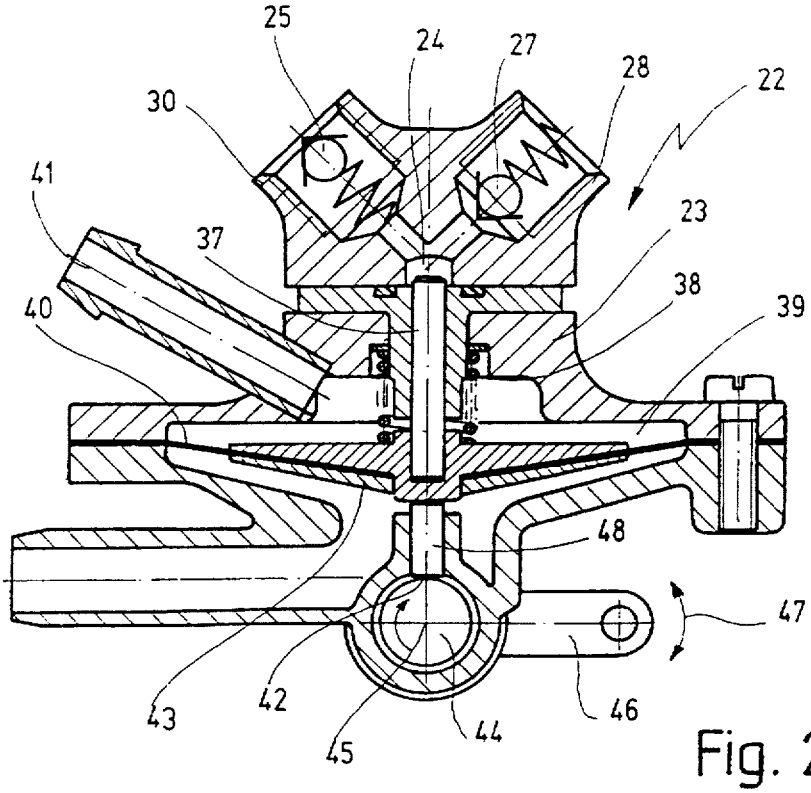
FIG. 2 shows a longitudinal section through the fuel pump in FIG. 1, in a structural embodiment.

For the highly precise metering of the fuel quantity injected by the fuel pump 22 into the combustion chamber 13 via the injection nozzle 14, which quantity must remain in a particular ratio to the combustion air supplied to the combustion chamber 13, a stop 42 is provided in the stroke path of the pump piston 37, which stop limits the intake stroke of the piston and whose relative position to the bottom dead center of the pump piston 37 can be controlled as a function of operating parameters of the two-stroke engine; here, this constitutes the position of the throttle valve 18 in the air intake conduit 17. In the exemplary embodiment of the fuel pump 22 in FIG. 1, the membrane 40 carries a stiffening 43 in the center which rests against the stop 42 in the bottom dead center of the pump piston 37, which stop is constituted here by the circumference of a cam 44. The cam 44 either has an elliptical outer contour and is supported in the center, or has a circular contour and is supported eccentrically. The support is carried out around a rotational axis 45 which is aligned lateral to the stroke direction of the pump piston 37, wherein the cam 44 is non-rotatably seated upon a rotary shaft, not shown here, which is supported in the pump housing 23 and which is non-rotatably engaged by an adjusting lever 46 (FIG. 2). The adjusting lever 46 is coupled to the throttle valve 18 via a rod, not shown here, so that it executes a pivoting movement shown in FIG. 2 by arrow 47 during the adjusting movement of the throttle valve 18. Because of this pivoting movement, the cam 44 is rotated and the stop 42 in the stroke path of the pump piston 37 is moved upward more or less, by means of which the intake stroke of the pump piston 37 becomes smaller or larger and as a result, the quantity of fuel aspirated into the pump chamber 24 by the pump piston 37 varies in size.

In the structural embodiment of the fuel pump according to FIG. 2, another coupling pin 48, which is guided so that it can move axially in the pump housing 23, is disposed between the cam 44 and the stiffening 43 on the membrane 40, which stiffening firmly receives the pump piston 37 on its end. The membrane stiffening 43 and therefore the pump piston 37 and the connecting pin 48 are held by the pump spring 38 in frictional, non-positive contact with the circumference of the cam 44.

Figure 3:
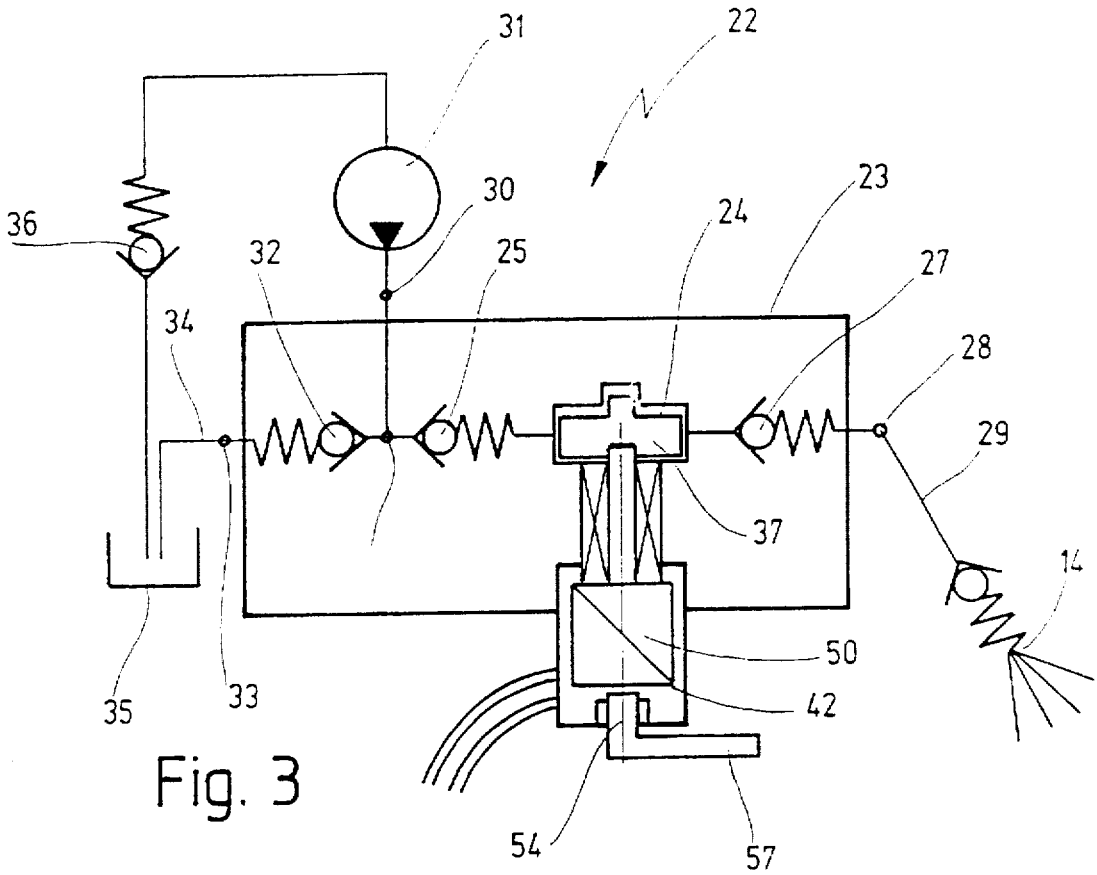
FIG. 3 shows a schematic representation of a fuel pump according to another exemplary embodiment.
Figure 4:
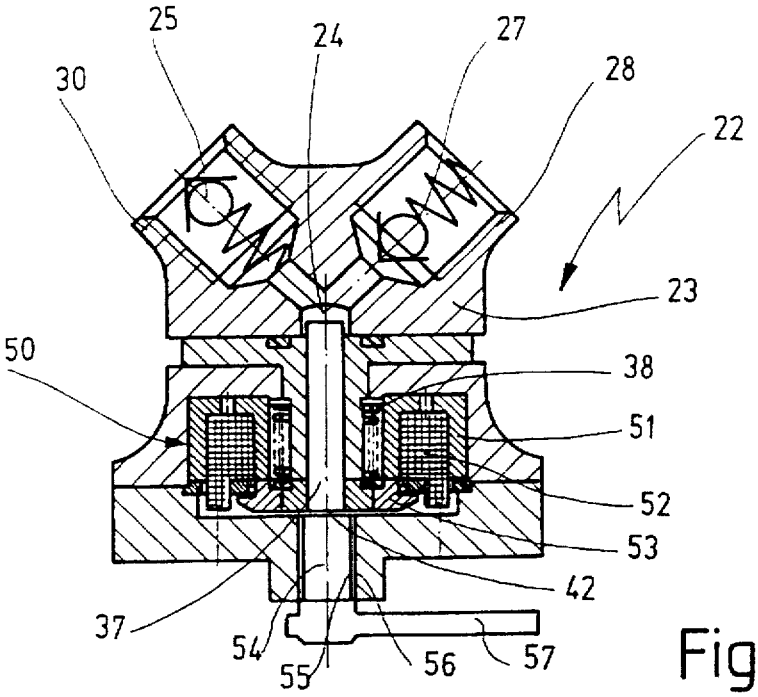
FIG. 4 shows a longitudinal section through the fuel pump in FIG. 3, in a structural embodiment.

The fuel pump 22 shown in FIG. 3 in a block circuit diagram and in FIG. 4 in a longitudinal section of a structural exemplary embodiment differs from the above-described fuel pump only by virtue of the fact that the pump piston 37 is not pneumatically, but electrically driven. Insofar as the same parts agree in FIGS. 3 and 4 on the one hand and in FIGS. 1 and 2 on the other, they are provided with the same reference numerals.

To electromagnetically drive the pump piston 37, an electromagnet 50 is disposed in the pump housing 23 coaxial to the pump piston 37, which electromagnet, in a known manner, has a magnet housing 51, a magnet excitation coil 52, and an armature 53. The armature 53 is firmly disposed on the end of the pump piston 37 oriented away from the pump chamber 24 and is supported on the pump housing 23 via the pump spring 38. The stop 42 for limiting the intake stroke of the pump piston 37 is constituted here by the end face of an adjusting piston 54, which can move axially and is disposed coaxial to the pump piston 37 on its end oriented away from the pump work chamber 24. For this purpose, the adjusting piston 54 is screwed with an external thread 55 into an internal thread 56 embodied in the pump housing 23. On its free end protruding from the pump housing 23, the adjusting piston 54 carries an adjusting lever 57, which protrudes at right angles and is coupled to a controlling unit. As described in FIGS. 1 and 2, the controlling unit can be an electric controlling unit with characteristic curve control or can be constituted by the throttle valve in the air intake fitting of the two-stroke engine. By pivoting the adjusting lever 57 into or out of the plane of the drawing, the adjusting piston 54 is moved axially toward the pump piston 37 or away from it, by means of which the relative position of the bottom dead center of the pump piston 37, and therefore the stroke path of the pump piston 37 during the intake stroke and the quantity of fuel aspirated are changed.

The foregoing relates to preferred exemplary embodiments of the invention, it being understood that other variants and embodiments thereof are possible within the spirit and scope of the invention, the latter being defined by the appended claims.

What is claimed and desired to be secured by letters patent of the United States is:

1. A fuel pump for a two-stroke internal combustion engine, comprises a crank case (10), at least one combustion cylinder (11) disposed in said crank case, an injection nozzle (14), an air supply opening (15), and an exhaust outlet opening (16), an air intake conduit (17), and a throttle valve (18), said conduit is attached to the air supply opening (15), a pump chamber (24), which is embodied in a pump housing (23) and communicates via an inlet valve (25) with a fuel supply (26) and communicates via an outlet valve (27) with a connection fitting (28) for an injection line (29) leading to the injection nozzle (14), and a pump piston (37), which defines the pump chamber (24) and is axially driven to execute a pumping motion with a feed and intake stroke, a stop (42) is provided to meter the fuel quantity delivered by the pump piston (37) via the outlet valve (27), said stop defines the intake: stroke of the pump piston (37) and whose relative position to the bottom dead center of the pump piston (37) is controlled as a function of operating parameters of the two-stroke engine, said stop (42) is constituted by a circumference of an eccentric cam (44), said cam is disposed in the pump housing (23) on the end face of the pump piston (37) remote from the pump chamber (24), so that the cam can rotate around a rotational axis (45) which is aligned lateral to the stroke direction of the pump piston (37), said cam (44) is non-rotatably seated upon a rotary shaft supported in the pump housing (23), said shaft is non-rotatably engaged by an adjusting lever (46), which is coupled to a controlling unit, said controlling unit is coupled to the throttle valve (18) in the air intake conduit (17) of the two-stroke engine.

2. The fuel pump according to claim 1, in which the stop (42) is constituted by a circumference of an eccentric cam (44), said cam is disposed in the pump housing (23) on the end face of the pump piston (37) remote from the pump chamber (24), so that the cam can rotate around a rotational axis 45) which is aligned lateral to the stroke direction of the pump piston (37).

3. The fuel pump according to claim 1, in which the cam (44) has an outer contour which is similar to an ellipse or is the shape of a rounded curve.

4. The fuel pump according to claim 2, in which the cam (44) is non-rotatably seated upon a rotary shaft supported in the pump housing (23), said shaft is non-rotatably engaged by an adjusting lever (46), which is coupled to a controlling unit.

5. The fuel pump according to claim 3, in which the cam (44) is non-rotatably seated upon a rotary shaft supported in the pump housing (23), said shaft is non-rotatably engaged by an adjusting lever (46), which is coupled to a controlling unit.

6. The fuel pump according to claim 5, in which the adjusting piston (54) is screwed with an external thread (55) into an internal thread (56) embodied in the pump housing (23) and on a free end, which protrudes from the pump housing (23), carries an adjusting lever (57), which is coupled to a controlling unit.

7. A fuel pump for a two-stroke internal combustion engine, comprises a crank case (10), at least one combustion cylinder (11) disposed in said crank case, an injection nozzle (14), an air supply opening (15), and an exhaust outlet opening (16), an air intake conduit (17), and a throttle valve (18), said conduit is attached to the air supply opening (15), a pump chamber (24), which is embodied in a pump housing (23) and communicates via an inlet valve (25) with a fuel supply (26) and communicates via an outlet valve (27) with a connection fitting (28) for an injection line (29) leading to the injection nozzle (14), and a pump piston (37), which defines the pump chamber (24) and is axially driven to execute a pumping motion with a feed and intake stroke, a stop (42) is provided to meter the fuel quantity delivered by the pump piston (37) via the outlet valve (27), said stop defines the intake stroke of the pump piston (37) and whose relative position to the bottom dead center of the pump piston (37) is controlled as a function of operating parameters of the two-stroke engine, said stop (42) is constituted by an end face of an adjusting piston (54), which, on an end face of the pump piston (37) remote from the pump chamber (24) moves in the pump housing (23) coaxial to the stroke direction of the pump piston (37), and a controlling unit is coupled to the throttle valve (18) in the air intake conduit (17) of the two-stroke engine.

8. The fuel pump according to claim 7, in which the controlling unit is coupled to the throttle valve (18) in the air intake conduit (17) of the two-stroke engine.

9. The fuel pump according to claim 1, in which the pump piston (37) is pneumatically driven and the pump housing (23) has a work chamber (39) which is connected to the crank case (10) of the two-stroke engine and which is defined by a membrane (40) attached to the pump piston (37), wherein a pump spring (38) drives the pump piston (37) during the intake stroke.

10. The fuel pump according to claim 2, in which the pump piston (37) is pneumatically driven and the pump housing (23) has a work chamber (39) which is connected to the crank case (10) of the two-stroke engine and which is defined by a membrane (40) attached to the pump piston (37), wherein a pump spring (38) drives the pump piston (37) during the intake stroke.

11. The fuel pump according to claim 3, in which the pump piston (37) is pneumatically driven and the pump housing (23) has a work chamber (39) which is connected to the crank case (10) of the two-stroke engine and which is defined by a membrane (40) attached to the pump piston (37), wherein a pump spring (38) drives the pump piston (37) during the intake stroke.

12. The fuel pump according to claim 3, in which the pump piston (37) is pneumatically driven and the pump housing (23) has a work chamber (39 which is connected to the crank case (10) of the two-stroke engine and which is defined by a membrane (40) attached to the pump piston (37), wherein a pump spring (38) drives the pump piston (37) during the intake stroke.

13. The fuel pump according to claim 7, in which the pump piston (37) is pneumatically driven and the pump housing (23) has a work chamber (39) which is connected to the crank case (10) of the two-stroke engine and which is defined by a membrane (40) attached to the pump piston (37), wherein a pump spring (38) drives the pump piston (37) during the intake stroke.

14. The fuel pump according to claim 6, in which the pump piston (37) is pneumatically driven and the pump housing (23) has a work chamber (39) which is connected to the crank case (10) of the two-stroke engine and which is defined by a membrane (40) attached to the pump piston (37), wherein a pump spring (38) drives the pump piston (37) during the intake stroke.

15. The fuel pump according to claim 1, in which the pump piston (37) is pneumatically driven and the pump housing (23) has a work chamber (39) which is connected to the crank case (10) of the two-stroke engine and which is defined by a membrane attached to the pump piston (37), wherein a pump spring (38) drives the pump piston (37) during the intake stroke.

16. The fuel pump according to claim 1, in which the pump piston (37) is electromagnetically driven and on a free end remote from the pump work chamber (39), is connected to an armature (53) of an electromagnet (50).

17. The fuel pump according to claim 7, in which the pump piston (37) is electromagnetically driven and on a free end remote from the pump work chamber (39), is connected to an armature (53) of an electromagnet (50).

18. The fuel pump according to claim 3, in which the pump piston (37) is electromagnetically driven and on a free end remote from the pump work chamber (39), is connected to an armature (53) of an electromagnet (50).

19. The fuel pump according to claim 5, in which the controlling unit is coupled to the throttle valve (18) in the air intake conduit (17) of the two-stroke engine.

* * * * *